US005979896A

United States Patent [19]

Lofink et al.

[11] Patent Number: 5,979,896

[45] Date of Patent: Nov. 9, 1999

[54] MODIFIED BACCARAT

[75] Inventors: Kurt Lofink; Richard Lofink, both of Las Vegas, Nev.

[73] Assignee: DP Stud, Inc., Las Vegas, Nev.

[21] Appl. No.: 08/980,483

[22] Filed: Nov. 28, 1997

[51] Int. Cl.[6] ..... A63F 1/00

[52] U.S. Cl. ..... 273/274; 273/303

[58] Field of Search ..... 273/292, 274, 273/303

[56] References Cited

U.S. PATENT DOCUMENTS 5,362,064 11/1994 Lofink et al. ..... 273/292
5,395,119 3/1995 Jacob et al. ..... 273/292 X
5,669,606 9/1997 Brown ..... 273/292 X
5,690,335 11/1997 Skratulia ..... 273/292

*Primary Examiner*—Jeanette Chapman
*Assistant Examiner*—Stephen L. Blau
*Attorney, Agent, or Firm*—Philip J. Anderson; Quirk & Tratos

[57] ABSTRACT

A modified method of playing either conventional Baccarat, or a modified Baccarat game with simplified draw rules is provided which can eliminate the commission charged to winning Bank hands by providing a partial payoff on one or more Bank winning outcomes. Further the method of the present invention can operate upon the Player hand as well to adjust the vigorish therefor. The method can be used to provide a no-commission game where the vigorish for the Bank and Player hands are substantially the same. Further the vigorish can be adjusted to at least partially fund a jackpot outcome.

10 Claims, No Drawings

MODIFIED BACCARAT

FIELD OF THE INVENTION

This invention relates to a method of playing a modified version of baccarat, and more particularly to a method of playing baccarat in which the commission heretofore charged by the gaming establishment for Bank winning hands is eliminated, wherein the vigorish is adjustable and which can be provided with a jackpot.

BACKGROUND OF THE INVENTION

Baccarat is one of the many live table games played in casinos or gaming establishments. Baccarat uses a standard deck of 52 playing cards and is usually dealt from a shoe having multiple decks that have been shuffled together prior to the beginning of play.

The object of the game of Baccarat is for the bettor to successfully wager on whether the Bank's hand or the Player's hand is going to win. The bettor receives even money for his wager if he selects the winning hand and loses his wager if he selects the losing hand. Because of the rules of play of Baccarat and more particularly the pre-established draw rules, the Bank's hand has a slightly higher chance of winning than does the Player's hand. The winning frequency for the Bank's hand has been determined to be 0.45859 (45.859%) whereas the winning frequency for the Player hand is 0.44624 (44.624%) with the remainder of the outcomes being ties. Therefore, if the bettor wagers on the Bank's hand and the Bank hand wins, the bettor must pay to the gaming establishment a commission (typically, 5%) of the amount the bettor wins. No commission is paid if the bettor successfully wagers on the Player's hand.

As used in this specification, the term "Conventional Manner of Play of Baccarat" is as follows:

A multiple number of decks of standard playing cards, 52 in number, are used; typically eight decks are shuffled together and placed in a shoe from which the cards are dealt during the play of the game.

Each bettor makes a wager on whether the Bank's hand or the Player's hand will win. After all wagers are made, two cards are dealt from the shoe to the Bank position and two cards are dealt from the shoe to the Player position on the table layout. The cards are turned face up and the value of the Bank hand the Player hand is determined, modulo ten.

Aces count one; Kings, Queens, Jacks and Tens count zero and the other cards count their respective face value. The suits (Spades, Hearts, Diamonds and Clubs) have no meaning in Baccarat.

The highest hand value in Baccarat is nine. All hand values range from a low of zero to a high of nine. If when the cards are added together, the total of the hand exceeds nine, then the hand value is determined modulo ten. For example, a seven and a eight total fifteen, but the hand value is five. An Ace and a nine total ten, but the hand value is zero.

A two card total of eight or nine is called a "natural"; a two card total of zero is called a "baccarat." As will be explained below, in certain situations in the play of the game, a third card will be dealt. The value of this third card is added to the total of the first two cards and a new hand value is established. Again, if the new hand total exceeds nine, the hand value is determined by subtracting ten from the total of the hand.

Prior to the deal, each better can make one of three wagers: 1) that the Bank hand will win; 2) that the Player hand will win; or 3) that the Bank hand and the Player hand will tie. Wagering locations are provided on the Baccarat table layout. Whichever of the Bank hand or the Player hand is closest to a total on nine is the winner.

All winning Bank hand wagers are paid off at odds of one-to-one and the house charges a five percent (5%) commission on the amount won by the bettor. For example, if a bettor wagers $100 on the Bank hand and the Bank hand wins, the bettor wins $100 and is charged a $5 commission on the amount that the bettor won. The bettor is not charged any commission on the amount of his wager.

All winning Player hand wagers are paid off at odds of one-to-one and the bettor is not charged any commission on the amount of his winnings or his wager because the house, by virtue of the third card draw rules, has a statistical advantage over the player of 45.859–44.624 or 1.235% which is the vigorish ("vig") of the house on player wagers. Winning wagers on the Tie hand bet are paid off at odds of nine-to-one or eight-to-one (depending on the gaming establishment) and the bettor is not charged any commission on the amount of his winnings or his wager since there is already a statistical advantage in favor of the house on tie wagers. If a Tie hand occurs, all wagers on the Bank hand and all wagers on the Player hand are "pushes" and the amount wagered is returned to the bettor.

Depending on the point total of the Player's hand and the Dealer's hand, one more card may be dealt to either the Player's hand, the Dealer's hand or both. The rules for determining whether a third card is dealt are fixed rules, there is no discretion for either the Player's hand or the Dealer's hand on whether a third card is dealt.

If either the Player hand or the Dealer hand has a point total of eight or nine on the first two cards, no third card is dealt to either hand and the hand with the highest point total is the winner (or the hand is a Tie, as the case may be). If neither the Player hand or the Dealer hand has a point total of eight or nine, then there is a possibility of a third card draw.

The third card draw rules are as follows:

Rule #1: If the initial two card Player hand has a point total of 0, 1, 2, 3, 4 or 5, the Player hand draws a third card. If the initial two card Player hand has a point total of 6 or 7, the Player hand stands and does not receive a third card.

Rule 12: If the Player hand stands and does not draw a third card, then the Bank hand follows Rule #1. In other words, if the Player hand has a point total of 6 or 7, the Bank hand draws a third card on a point total of 0, 1, 2, 3, 4 or 5 and the Bank hand stands on a point total of 6 or 7.

Rule 13: If the Player hand draws a third card, the Bank hand must draw or stand as follows:

| Bank hand two card point total | Bank hand DRAWS when the Player's hand third card is: | Bank hand STANDS when the Player's hand third card is: |
|---|---|---|
| 0, 1 or 2 | Bank always draws | |
| 3 | 0, 1, 2, 3, 4, 5, 6, 7 or 9 | 8 |
| 4 | 2, 3, 4, 5, 6 or 7 | 0, 1, 8 or 9 |
| 5 | 4, 5, 6 or 7 | 0, 1, 2, 3, 8 or 9 |
| 6 | 6 or 7 | 0, 1, 2, 3, 4, 5, 8 or 9 |
| 7 | | Bank always stands |

The draw rules for Conventional baccarat are shown in Table 1 below.

TABLE 1

| BACCARAT RULES | | |
|---|---|---|
| PLAYER | | |
| HAVING TWO CARD TOTAL OF | | |
| 1-2-3-4-5-10 | DRAWS A CARD | |
| 6-7 | STANDS | |
| 8-9 | TURNS CARDS OVER | |
| BANKER | | |
| HAVING TWO CARD TOTAL OF | DRAWS WHEN GIVING OR PLAYER'S THIRD CARD DRAW IS AN | DOES NOT DRAW WHEN GIVING OR PLAYER'S THIRD CARD DRAW IS AN |
| 0, 1, 2 | ALWAYS DRAWS | |
| 3 | 1-2-3-4-5-6-7-9-10 | 8 |
| 4 | 2-3-4-5-6-7 | 1-8-9-10 |
| 5 | 4-5-6-7 | 1-2-3-8-9-10 |
| 6 | 6-7 | 1-2-3-4-5-8-9-10 |
| 7 | STANDS | |
| 8-9 | TURNS CARDS OVER | |

At the end of each hand, winning wagers are paid and losing wagers are collected by the house. Any commission due to the house is marked in commission boxes in the center of the table. Gaming chips are used to represent the amount of money owed by each bettor to the house for the commissions. In order not to slow down the game, the commission is not actually collected from each bettor until the end of the round determined by all of the cards in the shoe being dealt down to the plastic cut card, usually approximately eighty hands.

The mathematical analysis of the game reveals that the 5% commission is what gives the house its advantage on wagers on the Banker hand and allows the gaming establishment to make a profit from providing the Baccarat game to the bettors. Because the rules for standing and drawing third cards are automatic, the mathematical analysis shows that the Bank hand will win 45.859% of the hands, the Player hand will win 44.624% of the hands and the Tie hand will occur 9.517% of the hands. If the Tie hands are disregarded because they do not affect any Player or Bank wagers, it is then determined that the Bank hand will win 50.7% of the time and the Player hand will win 49.3% of the time.

Because the Bank hand wins more than 50% of the hands (disregarding the Tie hands that do not affect any Player or Bank wagers), if a bettor always bet on the Bank hand, the bettor would have an advantage over the gaming establishment. By charging a 5% commission on all Bank hand wins, the gaming establishment compensates for the percentage of winning Bank hands being slightly over 50%.

After figuring in the 5% commission that must be paid by bettors on winning Bank hands, the gaming establishment has approximately a 1.23% advantage over the bettor when the bettor wagers on the Player hand and the gaming establishment has a 1.057% advantage over the bettor when the bettor wagers on the Bank hand. The Tie hand wager gives the gaming establishment a 4.88% advantage over the bettor when the payoff odds are nine-to-one and a 14.1% advantage over the bettor when the payoff odds are eight-to-one.

One of the detriments of the conventional manner of play of Baccarat is the necessity for calculating, recording and collecting this 5% commission on all winning Bank hand wagers. Many people are reluctant to sit down and participate because they do not understand why they should have to pay a 5% commission on winning Bank hand wagers. They may consider this unfair and something extra for the gaming establishment.

The gaming establishments also suffer disadvantages from the 5% commission. The determination of the 5% amount is done visually by a casino dealer and is subject to casino dealer error and disputes with the bettors over the amount of the commission. The reconciliation and collection of the commission at the end of each shoe can result in delays of the beginning of the next round of play. If a bettor loses all of his money ("taps out") during a round of the game, the gaming establishment may have difficulty collecting the unpaid commission that has accrued to that bettor during that round of the game. It has been estimated that as much as twenty percent of the accrued commission goes uncollected. Because the house margin on Baccarat is so small, uncollected commissions can seriously impact the profitability of a Baccarat table or the entire Baccarat pit, if more than one table is in play. In certain situations a bettor will negotiate with the casino for the casino to forgive or discount the owed commissions, the quid pro quo being that the player will likely return to the casino in the future Another detriment of the conventional manner of play of Baccarat is the complexity of the "third card" draw rules. These complicated rules deter new bettors from participating in the play of Baccarat.

To overcome these drawbacks we devised a modified baccarat game as disclosed in U.S. Pat. No. 5,362,064 issued Nov. 8, 1994 the disclosure of which is hereby incorporated by reference. In this patent we disclosed designating certain Banker and Player hand outcomes as "bar" hands for players wager on the Banker. As but an example where the Bank hand has a two card total of 4 and the Player has a hand total of 0, 1 or 2, paying wagers on the Bank is barred. By barring certain payoffs the vig provided by the 5% commission is statistically incorporated into the game and therefore need not be separately collected.

Because any modified, no commission game must be acceptable to both the players and the house there are several competing considerations. One consideration is that the game should have at least close to the same house advantage as Conventional baccarat including the commission. If the game has a higher vig than Conventional baccarat, there is no incentive to players to play a modified game. If the vig is lower, casinos may be reluctant to provide the game unless they make a conscious decision to offer a better game to entice players.

A drawback of providing the modified game designating certain hands as pushes is that to provide a vig comparable to that of Conventional baccarat only certain outcomes can be used. Thus a casino elects to bar certain hands, the vig and the hand combinations are determined. There is only limited flexibility in selecting barring outcomes.

Further there is no suitable means to infinitely adjust the vigorish. When certain outcomes are selected as barred hands, the vigorish is determined and cannot be adjusted.

A further drawback is that the casino cannot adjust the game to make the bar situations less complex. It would be desirable to provide a modified baccarat game where the casino can select a desired vigorish and select one or more certain, and easy to understand, combinations to operate upon to obtain the desired objective.

SUMMARY OF THE INVENTION

There is, therefore, set forth according to the present invention a modified method of playing conventional Baccarat or a modified draw rule game of Baccarat as described in our patent referred to above wherein the casino can either select a desired vigorish or select certain hand outcomes and, according to the present invention, obtain the desired result. It is a further object to provide a modified baccarat game where a jackpot can be offered for certain outcomes.

Toward this end a method for playing an improved no-commission Baccarat game is set forth wherein the casino establishes a range for a desired vigorish for the Bank or the Player hand. For example the casino may select a vigorish comparable to conventional Baccarat or a vigorish higher or lower for either of the hands. Where the Bank hand is to be operated upon, the casino selects one or more Bank hand outcomes (alone of in combination to Player hand outcomes). As but an example, Bank winning outcomes of a total of 5 may be selected. Based upon the desired vigorish and the selected outcome, the casino selects an amount to be paid to or collected from players having wagered upon the selected Bank outcome, e.g. when the Bank hands wins with a according to a formula of:

$$P_B = \frac{B_V - OBW_F + PW_F}{SWO_F}$$

where $P_B$ is the amount to be paid or collected, $B_V$ is the desired vigorish, $SWO_F$ is the statistical frequency of the selected Bank outcome, e.g. a winning outcome of a Bank hand of 5, $OBW_F$ is the combined frequencies of all other winning Bank outcomes and $PW_F$ is the combined statistical frequency for all Player hand winning outcomes.

For adjusting the vigorish on the Player hand side a like method according to the present invention can be used. A Player hand vigorish is selected as is a Player hand winning outcome and from that, the amount to be paid to or collected from player's wagering upon the Player hand can be determined according to the following formula:

$$P_P = \frac{P_V - OPW_F + BW_F}{SPW_F}$$

where $P_P$ is the amount to be paid or collected to obtain the desired vigorish, $P_V$ is the selected, desired vigorish, $SPW_F$ is the statistical frequency of the selected winning outcome occurring, e.g. how often a Player hand wins with a total of 4, $OPW_F$ is the combined statistical frequencies of the Player hand winning with other totals and $BW_F$ is the combined statistical frequencies of the Bank hand winning.

As can be appreciated, the casino can select one or more outcomes to operate upon and adjust the payoff to obtain any desired vigorish to make, for example, the vigorish for both the Player and Bank hands the same.

As a further feature of the present invention, the method includes providing a jackpot including a progressive jackpot greater than 1:1, the jackpot funded by adjusting the payoffs of one or more hand outcomes for both the Player and Bank hands to compensate for the greater payoff for the jackpot.

As can further be appreciated by providing a payoff or action rather than pushing the hand according to the prior art, reticence of players to play the game is reduced in that they will receive at least something, e.g. half, for the certain selected outcome. Further, the vigorish can be adjusted to any desired amount and selected outcomes to be operated upon can be chosen to make the game more simple while still providing the desired vigorish.

DETAILED DESCRIPTION OF THE PREFERRED EMBODIMENTS

The method of the present invention includes the casino selecting one or more parameters of the modified game to be played. As described below, the casino can select a desired vigorish and a selected hand winning, or for that matter losing outcomes such as, for example, a Bank winning hand of 5, and from those selected parameters determine the amount to be paid (less than even money but greater than zero) or collected from the winning hand. Alternatively the casino can select the amount to be paid and the desired vigorish, and from these selections determine an outcome which can provide the desired result. Accordingly the method provides a great degree of flexibility in crafting the modified game according to the present invention to obtain the desired result.

In regard to the method, each outcome in the game of either conventional Baccarat or a modified game having simplified draw rules as described in our prior patent U.S. Pat. No. 5,362,064, has a frequency of occurring. For example we have determined that the Bank wins with a 9 over the Player (with no third card draw) at a frequency of 0.08593205 or about 9% of the time. Like frequencies can be determined for other Bank winning outcomes, with or without third card draws, and even where the Bank wins over specific Player totals, e.g. a Bank wins with a 9 over a Player total of 5. Likewise, frequencies can be determined for Player winning totals over the Bank. By determining these frequencies we can determine to compensate for the inherent advantage of the Bank hand to the bettor.

The method of the present invention can best be described by providing an example of modifying the conventional Baccarat game to provide a game wherein the casino chooses to pay 1:2 (or 50%) on Bank winning wagers where the Bank wins with a 5 For example, if a bettor wagered $100 on the Bank and the Bank wins with a 5, the bettor would be paid $50 (plus retain their original wager). Once the hand to be operated upon (Bank winning hand of 5) and the amount to be paid is decided upon the vigorish that would be provided by such a game can be determined according to the following formula:

$$B_V = P_B \times SWO_F + OBW_F - PW_F$$

where $B_V$ is the vigorish which would be provided on the Bank side assuming all other rules of conventional Baccarat such as draw rules and 1:1 payoffs for all other winning outcomes is observed, $P_B$ is the amount to be paid for winning outcomes on the outcome to be operated upon, i.e. winning outcomes of 5 will be paid at 1:2 in this example, $SWO_F$ is the frequency of the selected outcome being a winning outcome, $OBW_V$ is the total of the winning frequencies for Bank winning hands for other than the $SWO_F$, i.e. is $BW_F - SWO_F$ (where $BW_F$ is the total of all Bank winning frequencies for all Bank totals, or 0.45859) and $PW_F$ is the frequency that the Player hand wins or 0.44624.

Thus in this example, with Bank winning outcomes of 5 selected to be paid at 1:2 (or 0.5), the vigorish $B_V$ can be determined. It has been determined that the selected Bank winning outcome $SWO_F$ of a 5 occurs at a frequency of 0.043357077 or about 4.3%. Based upon the above formula and the selection of the outcome and payoff the Bank vigorish $B_V$ can be calculated to be −0.0093 or 0.9%. This negative vigorish is close to the 1.057% for Bank winning hands in conventional Baccarat. By selecting other outcomes and/or other payoffs of greater than zero but less than even money the vigorish can be adjusted to the desired amount.

In a similar manner the vigorish on the Player hand side can also be adjusted to any desired level by altering the selection of outcomes and/or payoffs. When two of the three variables of payoff to the selected hand $P_P$, selected outcome $SPW_F$, or Player side vigorish $P_V$, the remaining variable can be determined from the following formula:

$$P_P = \frac{P_V - OPW_F + BW_F}{SPW_F}$$

where $OPW_F$ is the total Player hand winning frequency of 0.44624 minus $SPW_F$ and $BW_F$ is the total Bank hand winning frequency or 0.45859.

Thus it can be appreciated that the method can be used to adjust the vigorish to either the Bank hand or Player hand side of the game to, on the Bank hand side, eliminate or reduce the commission heretofore charged in conventional Baccarat while providing the same or any infinitely adjustable vigorish as desired. On the Player hand side, the vigorish can also be adjusted to any desired level. This feature of the present invention of virtually infinite adjustability can be used to craft a game which is desirable to bettors, by, for example, providing a game with a vigorish less than that of conventional Baccarat. This feature would attract bettors. The casino could also adjust the game to provide substantially the same vigorish to both the Player and Bank hands if desired.

More than one outcome may be operated upon to provide the desired outcome. For example, selecting to pay Bank winning outcomes of 4 (winning frequency of 0.03268) and 3 (winning frequency of 0.01459) at 1:2 will result in a Bank vigorish of 0.5×(0.03268+0.01459)+0.45859−0.03268−0.01459−0.44624 or approximately 1.128% slightly higher than the 1.058% vigorish for the Bank hand of conventional Baccarat.

As a further feature of the present invention, the vigorish of both the Bank and Player hands could be adjusted as described above to provide a higher vigorish than conventional Baccarat so that the casino could offer a jackpot. For example, the casino may offer a jackpot of a winning hand of a suited 9 and King over a suited hand of 8 and King. The jackpot may be progressive of funded at a fixed level based upon the adjusted vigorish of the Bank and Player hands and the frequency at which the jackpot outcome will occur. By being able to adjust the vigorish of both the Bank and Player hands, a jackpot can be provided and wholly or at least partially funded as a result of the adjusted vigorishes.

As can further be appreciated, by providing a payoff for the selected outcome hand according to the present invention, players are not disappointed as would be the case were the payoff is barred. There is always some action in regard to the selected winning outcome. Further the game can be made infinitely variable. All the operator of the game need do is select any two of the variables of vigorish, payoff or outcome and, according to the method of the present invention, the undetermined variable can be determined. Thus the establishment can decide that they wish to alter the vigorish and provide a payoff of 1:2 and therefrom determine the necessary selected outcome frequency to obtain the desired result. From the selected outcome frequency, winning outcomes having that frequency can be selected. This holds true, according to the present invention for both the Banker and Player hands.

While we have described certain embodiments of the present invention, it should be understood that it is subject to modifications and changes without departing from the spirit and scope of the appended claims.

We claim:

1. A method for playing a conventional or modified game of Baccarat having a Bank hands, a Player hand, and an established payoff table for winning outcomes, the game having any desired vigorish comprising:

(a) selecting any two of the following three variables, (1) vigorish, (2) a selected outcome to modify the established payoff should the selected outcome be a winning outcome, (3) an adjusted payoff greater than zero but less than 1:1 to pay to a bettor having wagered upon the selected outcome;

(b) from the two selected variables, determining the third variable; and (c) playing the game of Baccarat according to the rules therefor and paying the bettor the adjusted payoff when the bettor wagers upon the selected outcome and the selected outcome occurs.

2. The method of claim 1 wherein the selected outcome is a Bank winning hand, the adjusted payoff is selected to be 1:2 and the selected vigorish is approximately 1.057%.

3. The method of claim 1 further including selecting the vigorish for the Bank hand and the Player hand to be substantially similar.

4. The method of claim 1 further including providing a jackpot for certain outcomes and selecting the vigorish for the Bank and Player hands to at least partially fund the jackpot.

5. A method for playing a conventional or modified game of Baccarat having a Bank hand, a Player hand, and an established payoff table for winning outcomes the game having any desired vigorish comprising:

(a) selecting any two of the following three variables, (1) vigorish, (2) a selected outcome to modify the established payoff should the selected outcome be a winning outcome (3) an adjusted payoff greater than zero but less than 1:1 to pay to a bettor having wagered upon the selected outcome;

(b) from the two selected variables, determining the third variable according to the following formulas $$P_B = \frac{B_V - OBW_F + PW_F}{SWO_F}$$

where $P_B$ is the adjusted payoff to be provided to the player, $B_V$ is the vigorish, $SWO_F$ is the frequency of the selected outcome occurring, $OBW_F$ is the frequency of all Bank winning outcomes minus $SWO_F$ and $PW_F$ is the frequency of Player winning outcomes, $$P_P = \frac{P_V - OPW_F + BW_F}{SPW_F}$$

where $P_p$ is the adjusted payoff, $P_V$ is the vigorish, $SPW_F$ is the statistical frequency of the selected winning outcome occurring, $OPW_F$ is the frequency of all Player winning outcomes minus $SPW_F$ and $BW_F$ is the frequency of all Bank winning outcomes; and (c) playing the game of Baccarat according to the rules therefor and paying the bettor the adjusted payoff when the bettor wagers upon the selected outcome and the selected outcome occurs.

6. The method of claim 5 wherein the selected adjusted payoff is 1:2.

7. The method of claim 5 wherein the vigorish for the Bank hand is selected to be approximately 1.057%.

8. The method of claim 5 further including selecting the vigorish for the Bank hand and the Player hand to be substantially similar.

9. The method of claim 5 further including providing a jackpot for certain outcomes and selecting the vigorish for the Bank and Player hands to at least partially fund the jackpot.

10. The method of claim 5 wherein the selected payoff ranges between 1:4 to 3:4.

* * * * *